US006339856B1

(12) United States Patent
Chen et al.

(10) Patent No.: US 6,339,856 B1
(45) Date of Patent: Jan. 22, 2002

(54) PLAYYARD WITH HEIGHT ADJUSTABLE FEATURE

(75) Inventors: Er-Jui Chen, Feng-Shan; Pao-Shan Huang, Tai Pao; Huang-Yi Cheng, Chia-I Hsien, all of (TW)

(73) Assignee: Link Treasure Limited, Tortola (BV)

( * ) Notice: Subject to any disclaimer, the term of this patent is extended or adjusted under 35 U.S.C. 154(b) by 0 days.

(21) Appl. No.: 09/455,743

(22) Filed: Dec. 4, 1999

(51) Int. Cl.[7] ..... A47D 7/00
(52) U.S. Cl. ..... 5/99.1; 5/98.1; 403/109.3
(58) Field of Search ..... 5/99.1, 98.1; 403/109.3, 403/109.2

(56) References Cited

U.S. PATENT DOCUMENTS 2,698,443 A * 1/1955 Ralick ..... 5/99.1
2,719,688 A * 10/1955 Seifert ..... 403/109.3
4,044,411 A * 8/1977 Peterson ..... 5/99.1
4,124,906 A * 11/1978 Millard et al. ..... 5/99.1
4,247,216 A * 1/1981 Pansini ..... 403/109.3
4,376,318 A * 3/1983 Cirillo ..... 5/99.1
4,595,383 A * 6/1986 Nienhaus ..... 403/109.3
5,358,220 A * 10/1994 Yu-Kuang ..... 5/99.1
5,485,655 A * 1/1996 Wang ..... 5/99.1
5,957,436 A * 9/1999 Ristav ..... 5/99.1

FOREIGN PATENT DOCUMENTS

GB 2 061 099 * 5/1981 ..... 5/99.1

* cited by examiner

*Primary Examiner*—Alexander Grosz
(74) *Attorney, Agent, or Firm*—W. Wayne Liauh

(57) ABSTRACT

A collapsible playyard having a frame capable of being in an extended position and a collapsed position comprises one or more latches provided on upper frame member, lower frame member, and vertically extending rail of the frame respectively wherein vertically extending rail further consisting of a support tube and a sliding tube slidable in the support tube. Tubes are releasably attached together by a locking device. By utilizing this, the purpose of reducing height in addition to the reduction of width and length after collapsed is achieved.

3 Claims, 10 Drawing Sheets

PLAYYARD WITH HEIGHT ADJUSTABLE FEATURE

BACKGROUND OF THE INVENTION

1. Field of Invention

The present invention relates to collapsible playyards and more particularly to a playyard with height adjustable feature.

2. Related Art

Conventionally, a playyard is a safe confined space for children to play or sleep therein. U.S. Pat. Nos. 4,811,437, 4,985,948, 5163,191, 5,697,111, and 5,727,265 each discloses a design related to such playyard wherein Nos. 4,811,437, 5,697,111, and 5,727,256 each further discloses a collapsible playyard. Such playyards generally have two positions, i.e., an extended operating position and a collapsed position when not in use.

A conventional collapsible playyard as shown in FIGS. 1–3 generally comprises a frame and a soft fabric linen enclosed sides and bottom wherein frame includes an upper frame member, a lower frame member, and a plurality of vertically extending rails. One or more latches are provided on upper frame member and lower frame member respectively so as to collapse playyard for saving storing space when not in use (see FIG. 3 specifically). It is seen that the length and width are reduced. However, the height of playyard remains the same as prior to folding. As evident from above, efforts are still required to solve the problem of height not reduced after collapsed.

SUMMARY OF THE INVENTION

It is therefore an object of the present invention to provide a collapsible playyard wherein one or more latches are provided on upper frame member, lower frame member, and vertically extending rail of the frame respectively wherein vertically extending rail further consists of a support tube and a sliding tube slidable in the support tube. Tubes are releasably attached together by a locking device, thereby achieving the purpose of reducing height in addition to the reduction of width and length after collapsed.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow illustration only, and thus are not limitative of the present invention, and wherein.

DETAILED DESCRIPTION OF THE INVENTION

Figure 1:
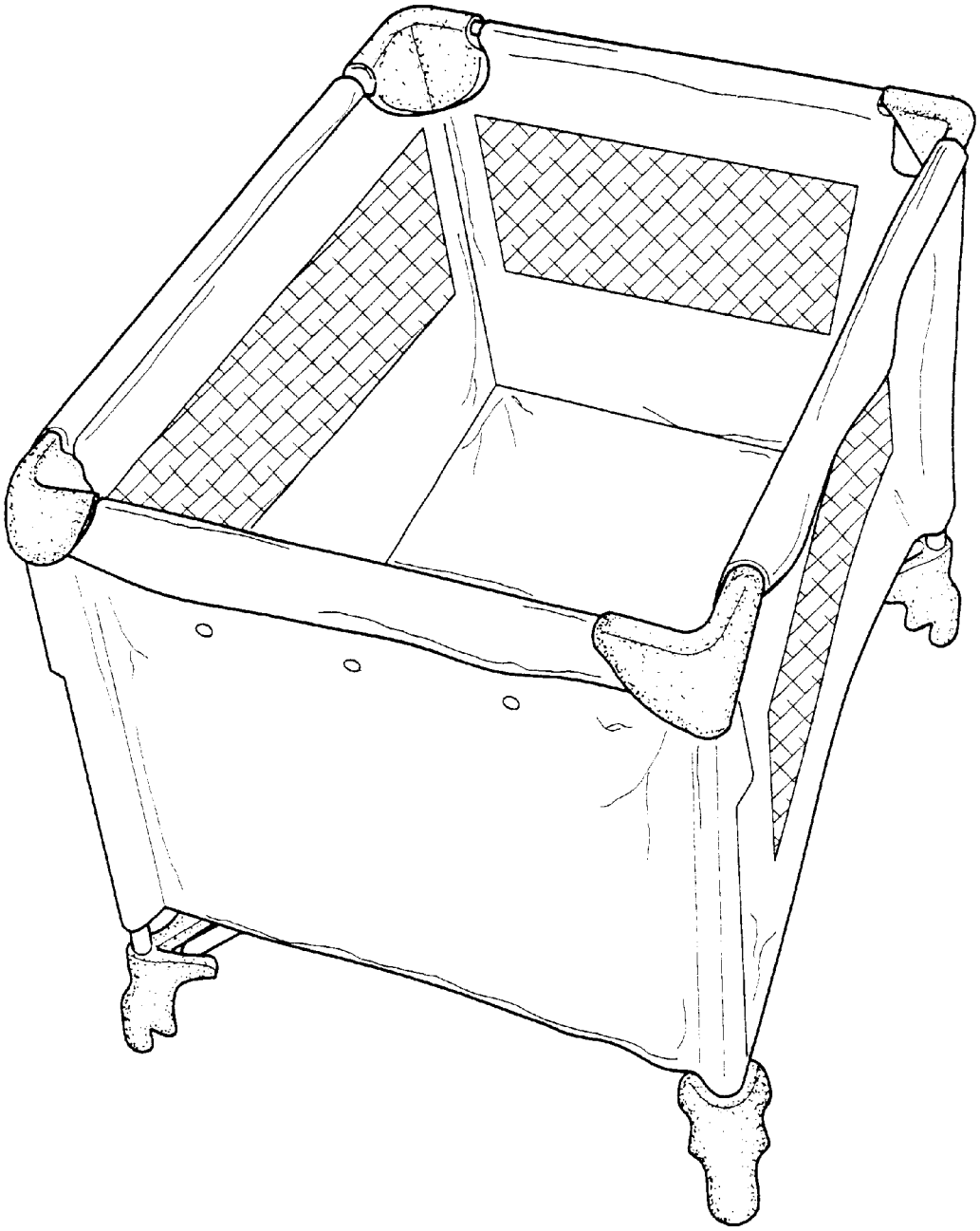
FIG. 1 (PRIOR ART)
FIG. 1 is a perspective view of a prior art collapsible playyard.
Figure 2:
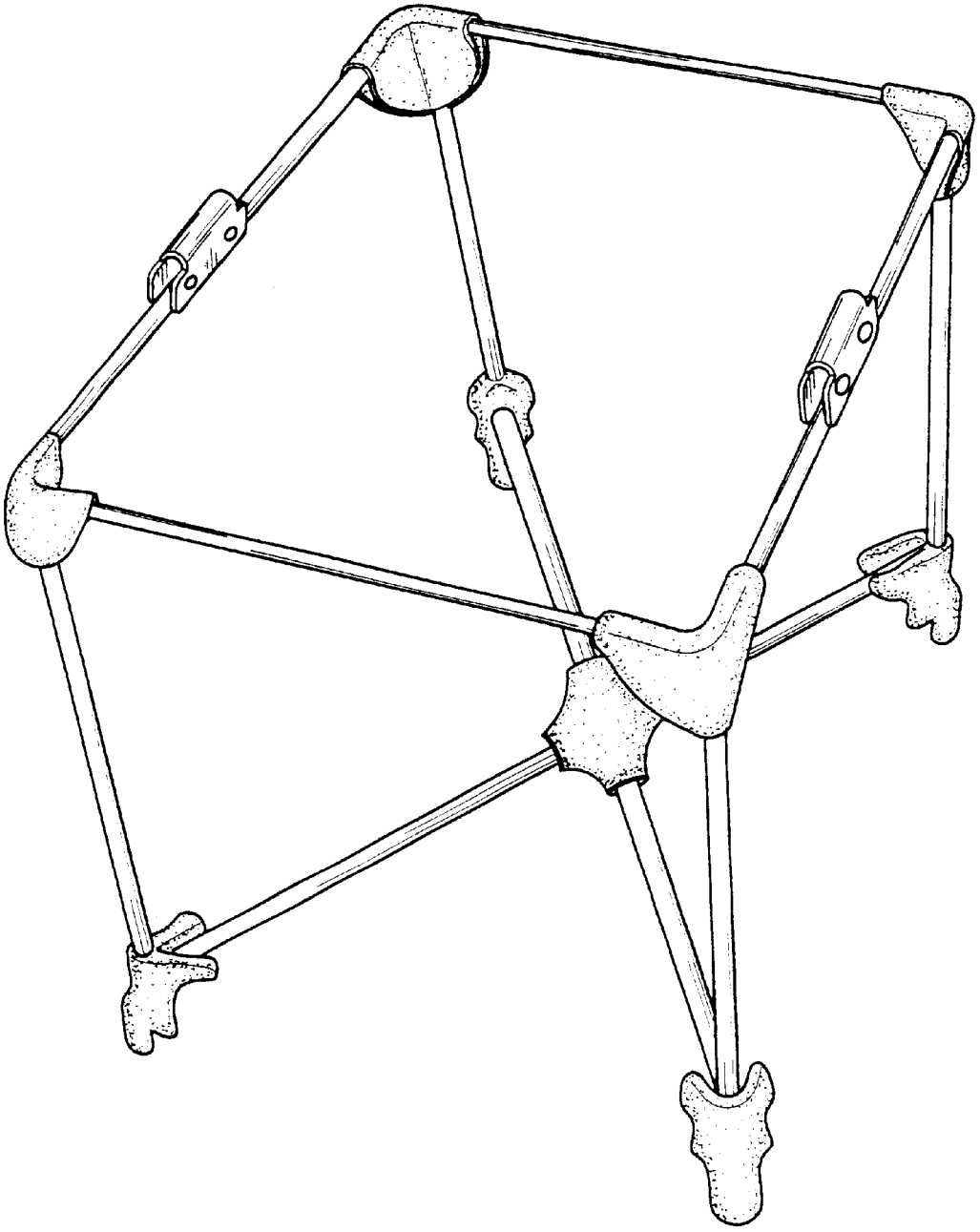
FIG. 2 (PRIOR ART)
FIG. 2 is a view similar to FIG. 1 with fabric removed to reveal the frame.
Figure 3:
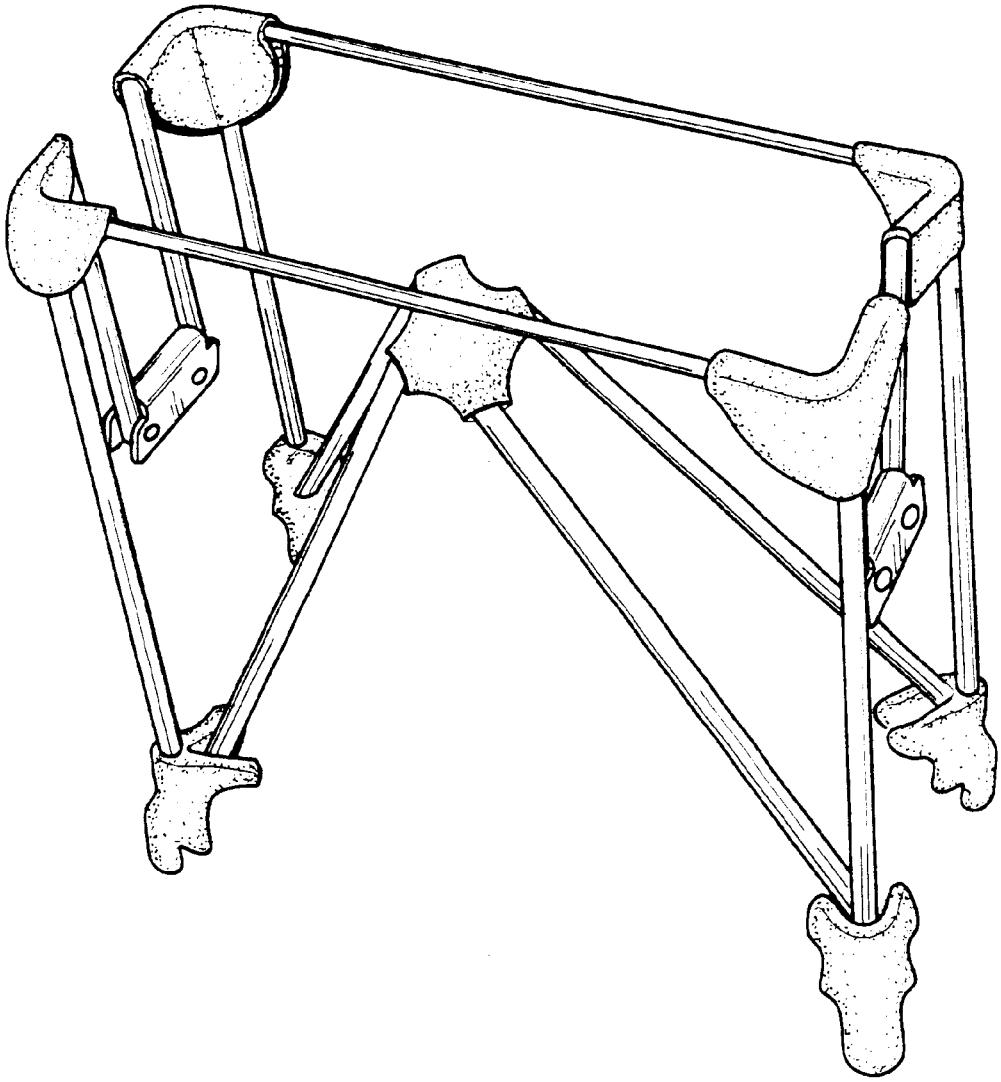
FIG. 3 (PRIOR ART)
FIG. 3 is a perspective view showing the collapse of the prior art playyard shown in FIG. 2.
Figure 4:
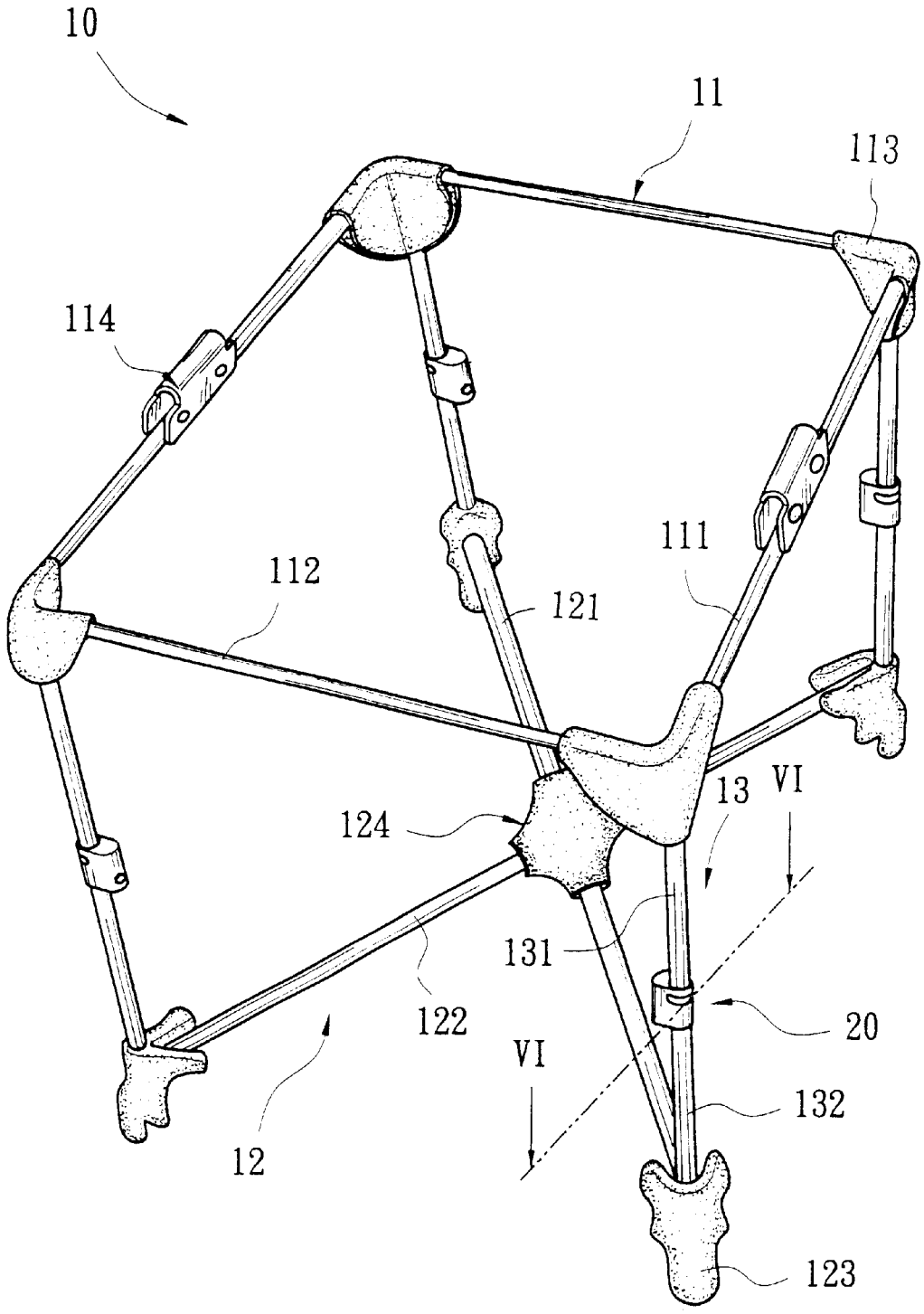
FIG. 4 is a perspective view of a preferred embodiment of a collapsible playyard of the present invention with fabric removed to reveal the frame.

Referring to FIG. 4, there is shown a playyard with height adjustable feature constructed in accordance with the present invention comprising a frame 10 including an upper frame member 11, a lower frame member 12, and a plurality of of vertically extending rails 13 wherein upper frame member 11 consists of two side rails 111 and two cross rails 112, and lower frame member 12 consists of two diagonal rails 121 and 122. Adjacent side rail 111, cross rail 112, and vertically extending rail 13 as well as adjacent diagonal rail 122 (or 121) and vertically extending rail 13 are attached together by brackets 113 and 123 respectively so as to form a complete frame.

Latch 114 is generally hinged in the central section of side rail 111 and latch 124 is generally hinged in the intersection of diagonal rail 121 and 122 respectively. By the provision of latches 114 and 124, each side rail 111 and diagonal rail 121 and 122 may extend to a straight member in an operating position and fold in a collapsed position so as to reduce length and width of frame. The latches 114 and 124 employed to collapse side rail and diagonal rail 121 and 122 are prior art members and thus their description is omitted herein for the sake of brevity.

The primary aspect of the invention is to design a playyard with height adjustable feature and thus a locking device 20 is provided. Locking device 20 functions as releasably attaching sliding tube 131 and support tube 132 of vertically extending rail 13 together and further sliding tube 131 is capable of retracting into support tube 132 a predetermined distance so as to reduce height of frame.

Figure 5:
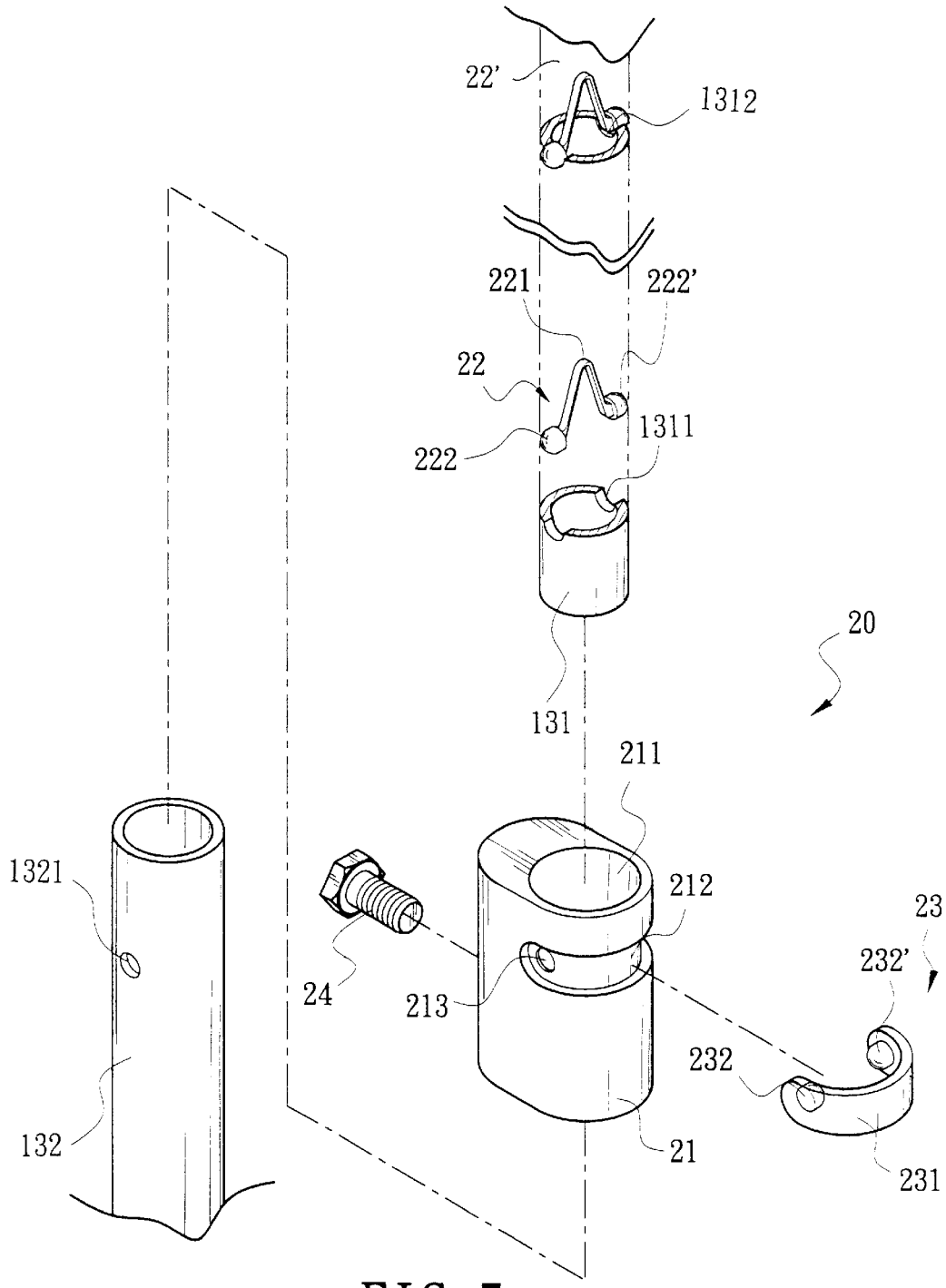
FIG. 5 is an exploded view illustrating vertically extending rail and latch of a vertically extending rail.
Figure 6A:
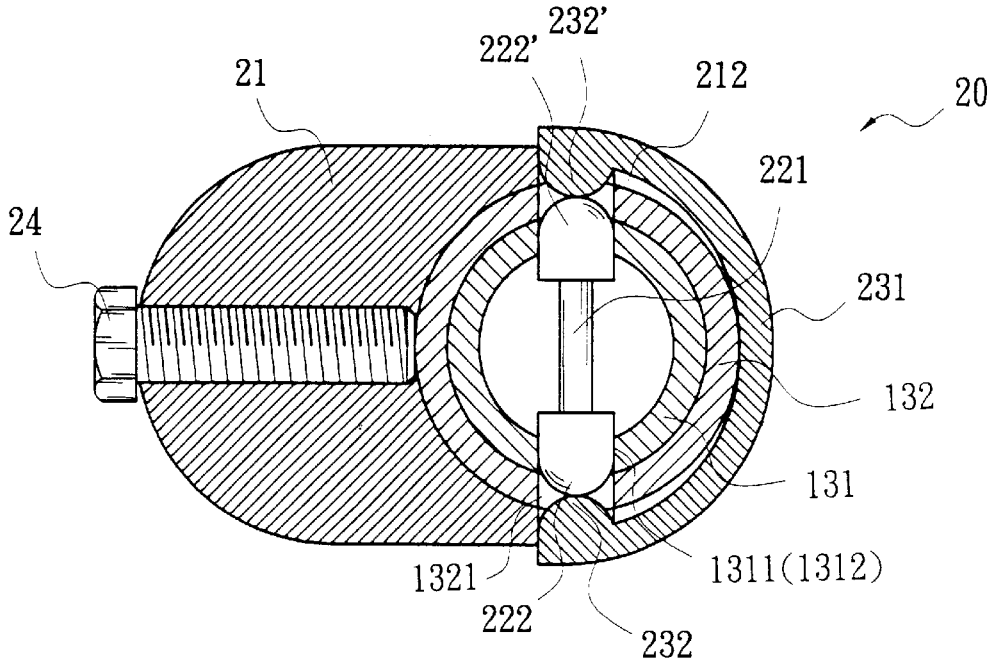
FIGS. 6A and 6B are sectional views taken along line VI—VI of FIG. 4 showing a locked and a released positions of the latch respectively.
Figure 6B:
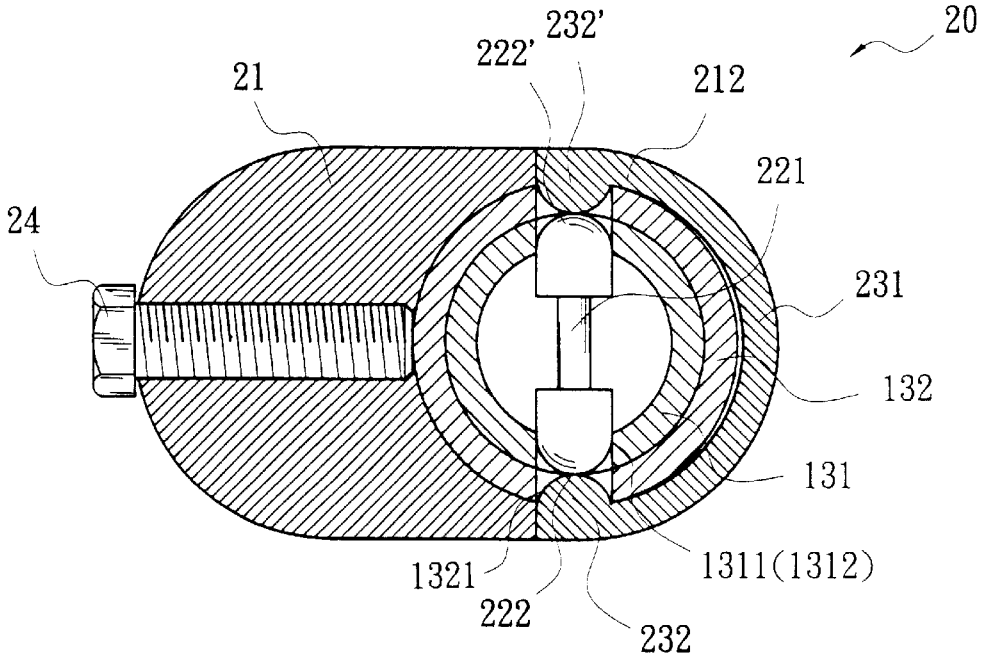

Referring to FIGS. 5, 6A, and 6B, locking device 20 comprises a bracket 21, an engaging means 22, and an actuation means 23 releasably attached to bracket 21. Engaging means 22 is provided in the sliding tube 131 having a V-shaped resilient member 221 with two round ends 222 and 222'. Round ends 222 and 222' are penetrated through apertures 1311 of sliding tube 131 and holes 1322 of support tube 132 by the exapansion of biased V-shaped resilient member 221 to engage sliding tube 131 and support tube 132.

Bracket 21 has a bore 211 for sleeving on support tube 132. Further, support tube 132 is sleeved on sliding tube 131. A bolt 24 is threaded through bracket 21 until being in contact with top portion of support tube 132 so as to fasten bracket 21 to support tube 132.

An arcuate recess 212 is provided on the outer surface of bracket 21 having two holes 213 and 213' on either end of arcuate recess 212 corresponding to holes 1321 and 1321' respectively. Actuation means 23 has a resilient actuation body 231 and two protrusions 232 and 232' on the inside of either end. Actuation means 23 is mounted on arcuate recess 212 with protrusions 232 and 232' inserted into the corresponding holes 213 and 213' to be in contact with round ends 222 and 222'. It is seen that the contact points of protrusions 232 and 232' with round ends 222 and 222' are in the hole 213 and 213' as shown in FIG. 6A. As a result, sliding tube 131 and support tube 132 are locked in the bracket 21. However, protrusions 232 and 232' will apply a force on round ends 222 and 222' if a force is exerted on protrusions 232 and 232', for example, by a hand simultaneously. As such, round ends 222 and 222' are completely received within the apertures 1311 of sliding tube 131 if such force is sufficient as shown in FIG. 6B. Accordingly, sliding tube 131 is unlocked so as to be capable of moving down a predetermined distance relative to the support tube 132 by pressing vertically extending rail 13 from top end thereof.

Figure 7:
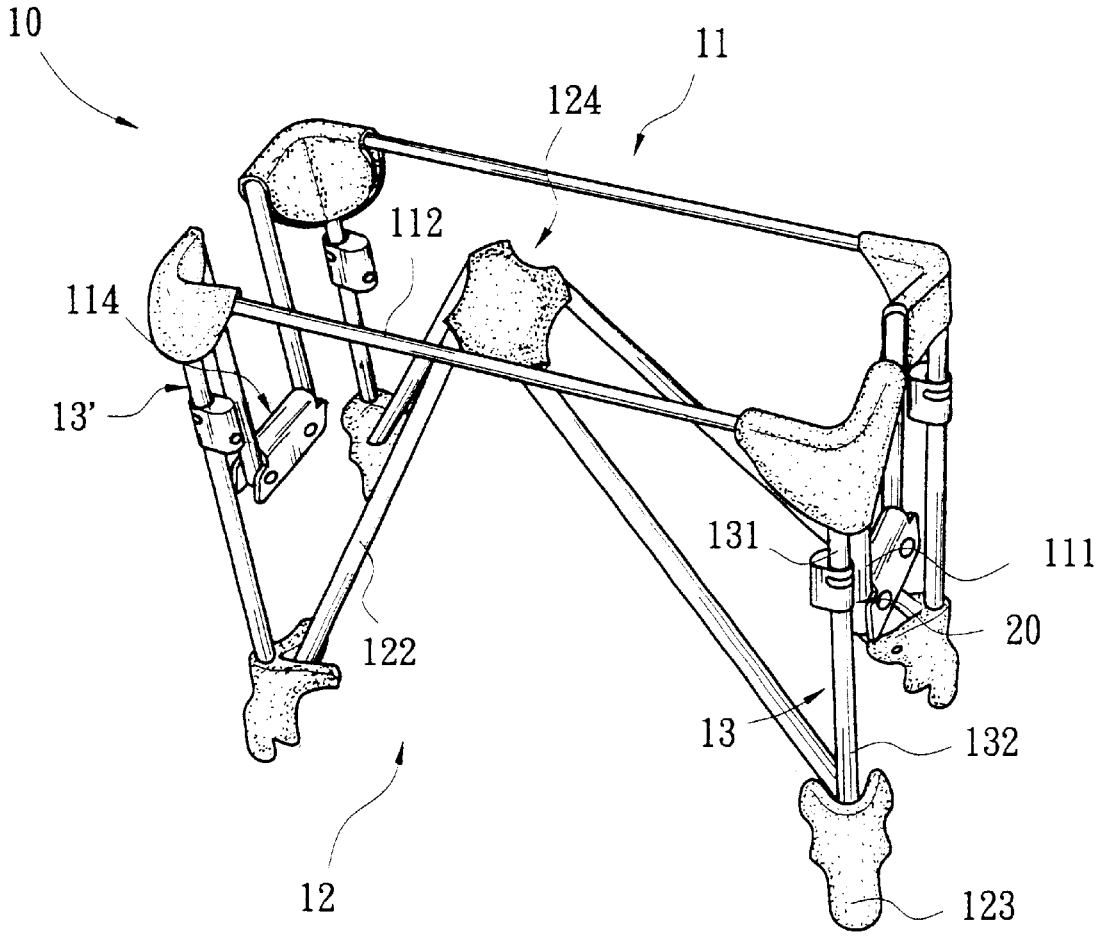
FIG. 7 is a perspective view showing the collapse of playyard shown in FIG. 4 wherein vertically extending railshave collapsed to a minimum height.

By utilizing this, vertically extending rail 13 may extend to a maximum height when sliding tube 131 is extended up from support tube 132 a predetermined distance as shown in FIG. 4 or collapse to a minimum height when sliding tube 131 is retracted into support tube 132 the same distance as shown in FIG. 7. For achieving such collapsing purpose, a pair of engaging means 22 and 22' are required to be provided in the sliding tube 131 as shown in FIG. 4. That is, vertically extending rail 13 is extended to the maximum height when sliding tube 131 and support tube 132 are secured by the lower engaging means 22, while vertically extending rail 13 is retracted to the minimum height when sliding tube 131 and support tube 132 are secured by the higher engaging means 22'.

Figure 8:
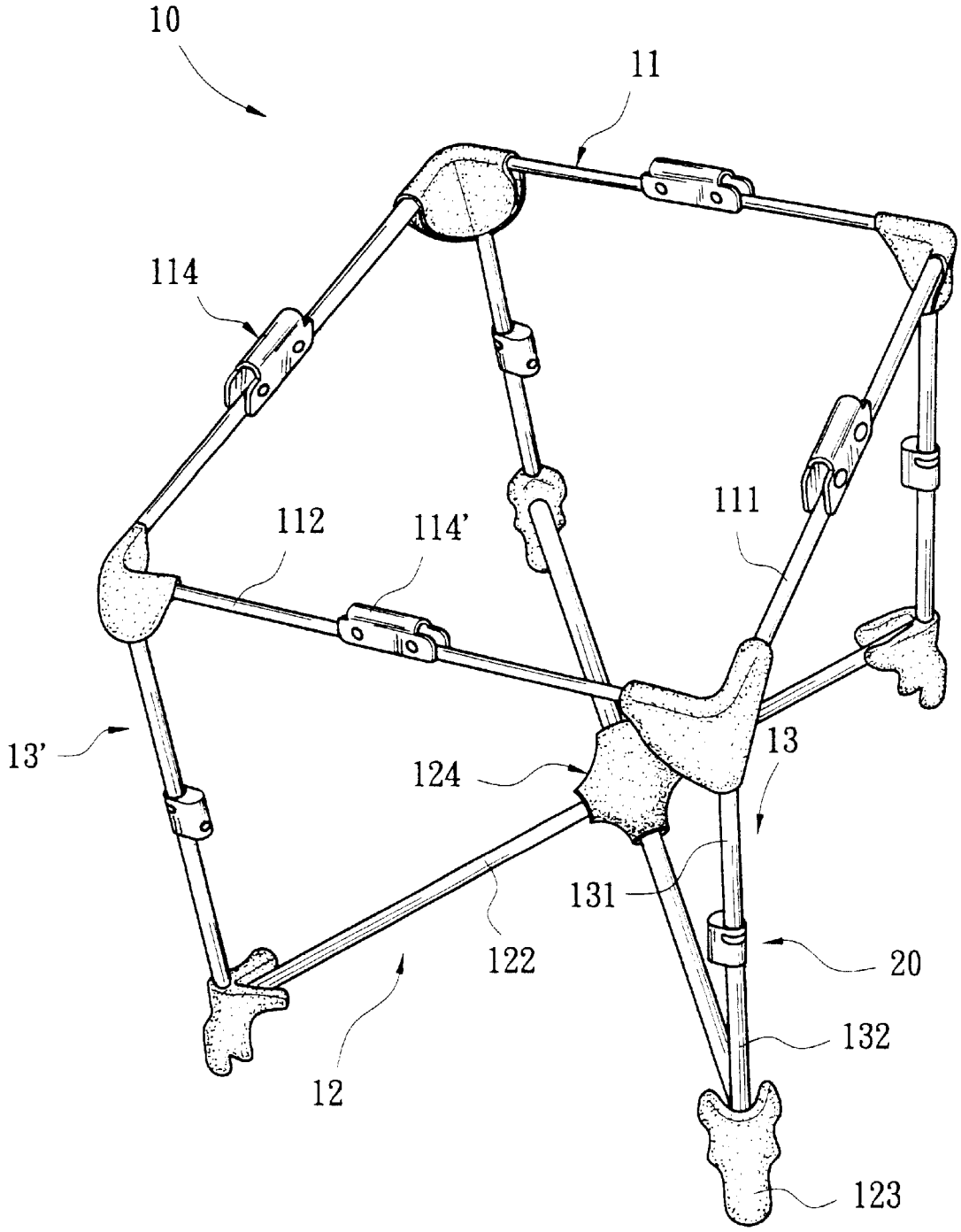
FIG. 8 is a perspective view of an alternate embodiment of frame of the present invention.
Figure 9:
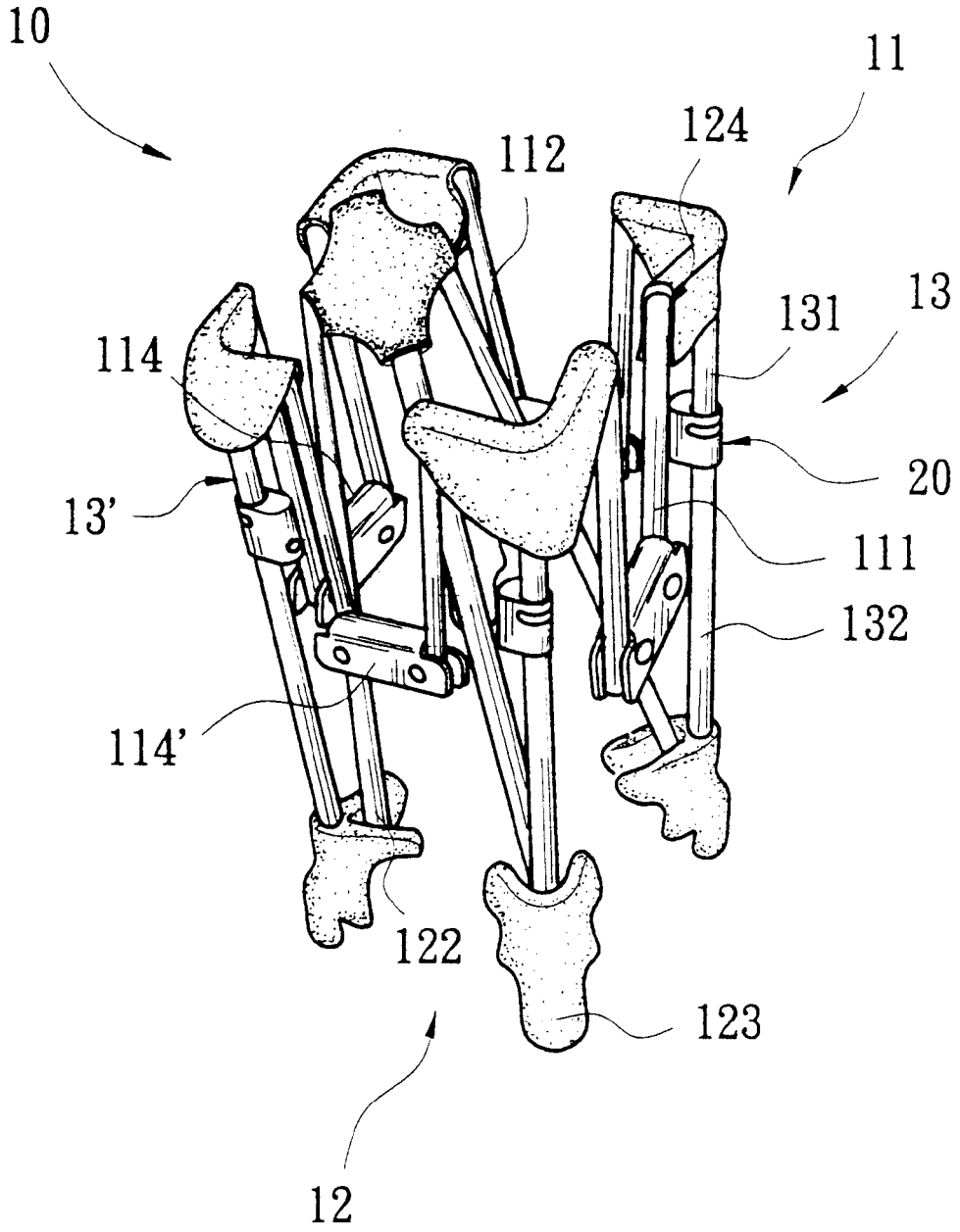
FIG. 9 is a perspective view showing the collapse of frame shown in FIG. 8.

Only two latches 114 are provided on either side rail 111 and as such only two sides can be folded as shown in FIG. 7. However, such reduction in length is not enough. Thus, in an alternate embodiment of frame of the present invention, additional two latches 114' are provided on either cross rail 112 as shown in FIG. 8. With such arrangement, a more compact space is achieved when frame is folded as shown in FIG. 9.

Figure 10A:
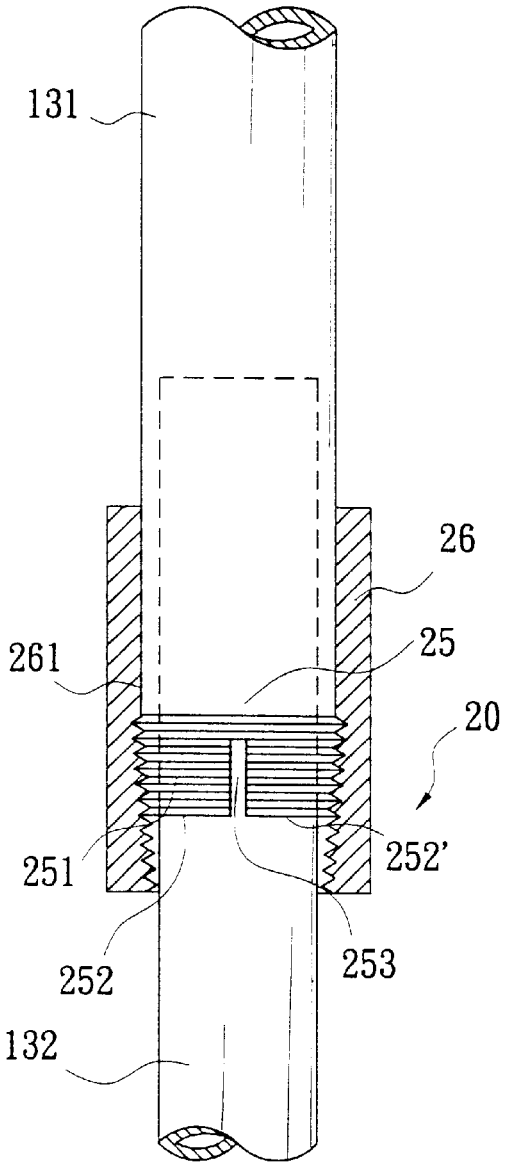
FIGS. 10A and 10B are longitudinal sectional views of an alternate embodiment of locking device respectively.
Figure 10B:
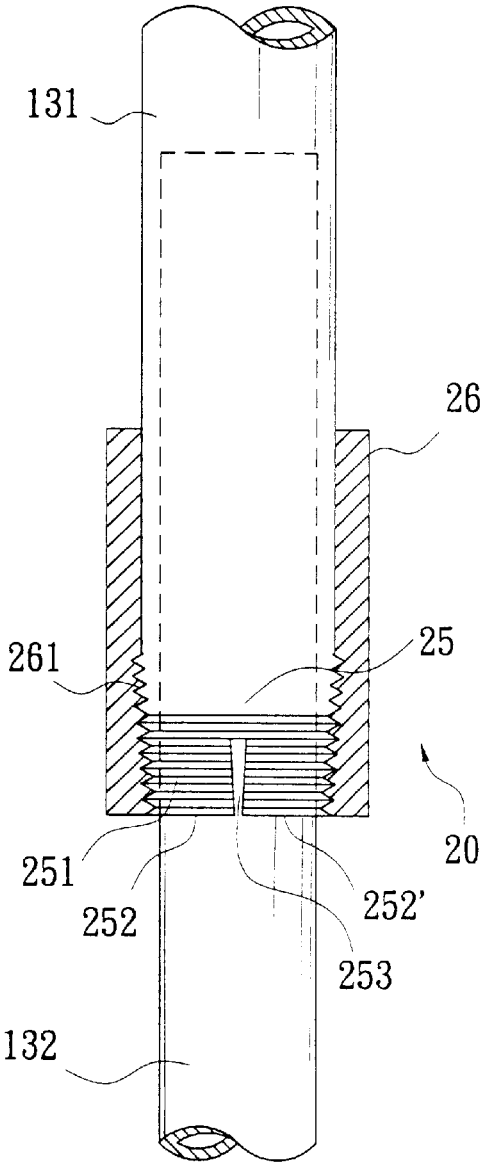

Referring to FIGS. 10A and 10B, there is shown an alternate embodiment of locking device respectively. In this embodiment, locking device 20 comprises a resilient member 25 enclosing support tube 131 at one end and a sleeve member 26 securing resilient member 25 to sliding tube 132 wherein resilient member 25 includes a plurality of projecting ridges 252 and 252' protruded from the surface, an elongate recess 253 formed between projecting ridges 252 and 252', and a plurality of internal threads 251 each formed between two adjacent ridges 252 as well as between two adjacent ridges 252'. Resilient member 25 is threadly secured to internal threads 261 on the inner surface of sleeve member 26.

With such arrangement, ridge 252 and 252' are forced to contract when sleeve member 26 is threaded up because the bore of sleeve member 26 is tapered to the lower end as shown in FIG. 10B. Further, the friction between ridges 252 and 252' and sliding tube 132 will refrain sliding tube 132 from moving with respect to support tube 131 and thus locking sliding tube 132 in support tube 131. To the contrary, ridges 252 and 252' are returned to their original uncompressed shapes when sleeve member 26 is threaded down to cause the above friction to decrease to a predetermined minimum value or completely diminished as shown in FIG. 10A. At this point, sliding tube 132 may move relative to support tube 131 in order to change height of the vertically extending rail 13.

Note that internal thread 251 may be a double-groove thread or a triple-groove thread. Further, sleeve member 26 is designed to be quickly engaged with or disengaged from resilient member 25.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A collapsible playyard having a frame capable of being in an extended position and a collapsed position, the frame comprising:

an upper frame member comprising a plurality of side rails;

a lower frame member comprising a plurality of diagonal rails;

a plurality of vertically extending rails, each comprising a support tube and a sliding tube slidable in the support tube; and a plurality of locking devices;

wherein:

two adjacent side rails and a top end of the vertically extending rails are joined together by a first bracket, and each end of the diagonal rail is attached to a bottom end of one of the vertically extending rails by a second bracket; and each of the locking devices comprises a third bracket mounted on one of the support tubes and two engaging members provided in a corresponding sliding tube, the third bracket and the engaging members cooperate to releasably lock the support tube and the sliding tube in the extended position and the collapsed position, respectively;

further wherein the engaging member comprises a biased V-shaped resilient member having two raised ends, the raised ends are structured to respectively penetrate through two apertures of the sliding tube, two holes of the bracket, and two holes of the support tube by an exapansion of the biased V-shaped resilient member to engage the sliding tube with the support tube at either an extended or a collapsed position.

2. A collapsible playard having a frame capable of being in an extended position and a collapsed position, the frame comprising:

an upper frame member comprising a plurality of side rails;

a lower frame member comprising a plurality of diagonal rails;

a plurality of vertically extending rails, each comprising a support tube and a sliding tube slidable in the support tube; and a plurality of locking devices;

wherein:

two adjacent side rails and a top end of the vertically extending rails are joined together by a first bracket, and each end of the diagonal rail is attached to a bottom end of one of the vertically extending rails by a second bracket; and each of the locking devices comprises a third bracket mounted on one of the support tubes and an actuation member which can be detached from the support tube, the third bracket cooperates with an actuation member to releasably lock the support tube and the sliding tube in the extended position and the collapsed position, respectively;

further wherein the actuation member is an arcuate resilient body with two protrusions protruded inwardly from two inner ends, respectively, of the resilient body, the actuation member is engageable with the third bracket by allowing the protrusions to be respectively inserted into two holes of the support tube, two holes of the third bracket, and two corresponding apertures of the sliding tube at either an extended or a collapsed position.

3. A collapsible playyard having a frame capable of being in an extended position and a collapsed position, the frame comprising:

an upper frame member comprising a plurality of side rails;

a lower frame member comprising a plurality of diagonal rails;

a plurality of vertically extending rails, each comprising a support tube and a sliding tube slidable in the support tube; and a plurality of locking devices;

wherein:

two adjacent side rails and a top end of the vertically extending rails are joined together by a first bracket, and each end of the diagonal rail is attached to a bottom end of one of the vertically extending rails by a second bracket; and each of the locking devices comprises a third bracket mounted on one of the support tubes and two engaging members provided in a corresponding sliding tube, the third bracket and the engaging members cooperate to releasably lock the support tube and the sliding tube in the extended position and the collapsed position, respectively;

further wherein the engaging member comprises an outwardly-urging resilient member having two raised ends, the raised ends are structured to respectively penetrate through two apertures of the sliding tube, two holes of the bracket, and two holes of the support tube by an expansion of the outwardly-urging resilient member to engage the sliding tube with the support tube at either an extended or collapsed position.

* * * * *